US009096086B2

(12) United States Patent
Sano et al.

(10) Patent No.: US 9,096,086 B2
(45) Date of Patent: Aug. 4, 2015

(54) INKJET RECORDING APPARATUS HAVING FRAME FOR SUPPORTING CARRIAGE

(71) Applicants: Iwane Sano, Obu (JP); Masao Mimoto, Nagoya (JP); Yasuhira Ota, Yatomi (JP); Noriyuki Kawamata, Nagoya (JP); Keisuke Wakakusa, Nagoya (JP); Jie Xiu, Nagoya (JP); Shingo Ito, Kasugai (JP)

(72) Inventors: Iwane Sano, Obu (JP); Masao Mimoto, Nagoya (JP); Yasuhira Ota, Yatomi (JP); Noriyuki Kawamata, Nagoya (JP); Keisuke Wakakusa, Nagoya (JP); Jie Xiu, Nagoya (JP); Shingo Ito, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/181,835

(22) Filed: Feb. 17, 2014

(65) Prior Publication Data

US 2014/0232799 A1 Aug. 21, 2014

(30) Foreign Application Priority Data

Feb. 18, 2013 (JP) ..... 2013-028730

(51) Int. Cl.

| | |
|---|---|
| ***B41J 2/01*** | (2006.01) |
| ***B41J 29/02*** | (2006.01) |
| ***B41J 11/00*** | (2006.01) |
| ***B41J 13/02*** | (2006.01) |
| ***B41J 29/13*** | (2006.01) |

(52) U.S. Cl.

CPC ..... *B41J 29/02* (2013.01); *B41J 11/007* (2013.01); *B41J 13/025* (2013.01); *B41J 29/13* (2013.01)

(58) Field of Classification Search

CPC ..... B41J 11/007; B41J 11/06; B41J 11/0085
USPC ..... 347/104
See application file for complete search history.

(56) References Cited

U.S. PATENT DOCUMENTS

| | | | | |
|---|---|---|---|---|
| 5,398,049 | A * | 3/1995 | Terasawa et al. | 347/8 |
| 5,838,356 | A | 11/1998 | Gunther et al. | |
| 5,897,259 | A * | 4/1999 | Ahn | 400/629 |
| 5,938,356 | A * | 8/1999 | Wirth et al. | 400/636.3 |

(Continued)

FOREIGN PATENT DOCUMENTS

| | | |
|---|---|---|
| CN | 1861412 A | 11/2006 |
| CN | 1865002 A | 11/2006 |

(Continued)

OTHER PUBLICATIONS

May 6, 2015—(CN) Notification of First Office Action—App. 201410054293.1—Eng. Tran.

*Primary Examiner* — Jannelle M Lebron
*Assistant Examiner* — Jeremy Bishop
(74) *Attorney, Agent, or Firm* — Banner & Witcoff, Ltd.

(57) ABSTRACT

In an inkjet recording apparatus, a support frame has a support part, and supports a carriage on a first surface of the support part. A pinch roller is disposed on a second surface side of the support part, the second surface being opposite from the first surface. A conveying roller is disposed opposite to the support frame relative to the pinch roller and in confrontation with the pinch roller. A roller holder is disposed on the second surface side of the support part and supporting the pinch roller. An urging member is interposed between the roller holder and the support part, and urges the roller holder to press the pinch roller against the conveying roller. The carriage is in contact with the first surface of the support part while the urging member is in contact with the second surface of the support part.

9 Claims, 10 Drawing Sheets

(56) References Cited

U.S. PATENT DOCUMENTS

| | | | | |
|---|---|---|---|---|
| 6,169,557 | B1 | 1/2001 | Suzuki et al. | |
| 7,566,124 | B2 | 7/2009 | Kan et al. | |
| 7,607,663 | B2 | 10/2009 | Sugiyama | |
| 7,637,589 | B2 | 12/2009 | Nakano et al. | |
| 7,735,991 | B2 | 6/2010 | Asano | |
| 8,094,180 | B2 * | 1/2012 | Onuma et al. | 347/262 |
| 8,789,940 | B2 * | 7/2014 | Kawamata | 347/104 |
| 2005/0035992 | A1 | 2/2005 | Sugiyama | |
| 2005/0264635 | A1 | 12/2005 | Kan et al. | |
| 2006/0256180 | A1 | 11/2006 | Asano | |
| 2007/0296776 | A1 | 12/2007 | Nakano et al. | |

FOREIGN PATENT DOCUMENTS

| | | | | | |
|---|---|---|---|---|---|
| JP | 11138923 | A | * | 5/1999 | B41J 11/02 |
| JP | 2005-022128 | A | | 1/2005 | |
| JP | 4737430 | B2 | | 8/2011 | |

* cited by examiner

INKJET RECORDING APPARATUS HAVING FRAME FOR SUPPORTING CARRIAGE

CROSS REFERENCE TO RELATED APPLICATION

This application claims priority from Japanese Patent Application No. 2013-028730 filed Feb. 18, 2013. The entire content of this priority application is incorporated herein by reference.

TECHNICAL FIELD

The present invention relates to an inkjet recording apparatus for recording an image on a sheet by ejecting ink droplets from nozzles toward the sheet.

BACKGROUND

A known inkjet recording apparatus is provided with a carriage, and a recording head supported in the carriage. Nozzles are formed in the recording head. The carriage moves in a main scanning direction that is orthogonal to the sheet-conveying direction. As the carriage is moved, the recording head ejects ink droplets through the nozzles toward a sheet. Through this operation, an image is recorded on the sheet over a prescribed range in the main scanning direction. The inkjet recording apparatus also includes a support frame that is elongated in the main scanning direction. The support frame supports the carriage so that the carriage can move in the main scanning direction.

Another known inkjet recording apparatus is provided with a pair of conveying rollers for conveying the sheet during a recording operation. The pair of conveying rollers includes a conveying roller that rotates when driven by a motor, and pinch rollers that follow the rotation of the conveying roller. Urging members are provided for urging the pinch rollers to contact the conveying roller with pressure. The urging members are disposed between a frame, which is different from a support frame for supporting a recording head carriage, and a roller holder serving to hold the pinch rollers.

SUMMARY

The invention provides an inkjet recording apparatus including: a carriage; a support frame; a pinch roller; a conveying roller; a roller holder; and an urging member. The carriage is configured to move in a width direction orthogonal to a conveying direction in which a sheet is conveyed, the carriage supporting a recording head configured to eject ink droplets from nozzles onto the sheet conveyed, thereby recording an image on the sheet. The support frame has a support part of a flat plate shape extending in both the conveying direction and the width direction, the support frame supporting the carriage on a first surface of the support part such that the carriage is movable in the width direction. The pinch roller is disposed on a second surface side of the support part, the second surface being opposite from the first surface with respect to an orthogonal direction, the orthogonal direction being orthogonal to both the conveying direction and the width direction. The conveying roller is disposed opposite to the support frame relative to the pinch roller and in confrontation with the pinch roller, the conveying roller being configured to convey the sheet that is interposed between the conveying roller and the pinch roller. The roller holder is disposed on the second surface side of the support part with respect to the orthogonal direction and supporting the pinch roller. The urging member is interposed between the roller holder and the support part, the urging member being configured to urge the roller holder so as to press the pinch roller against the conveying roller. The carriage is in contact with the first surface of the support part while the urging member is in contact with the second surface of the support part.

BRIEF DESCRIPTION OF THE DRAWINGS

The particular features and advantages of the invention as well as other objects will become apparent from the following description taken in connection with the accompanying drawings, in which:

FIGS. 9A and 9B show a base frame and various members mounted on the base frame, wherein FIG. 9A shows the state where the movable members are at a first position, and FIG. 9B shows the state where the movable members are at a second position.

DETAILED DESCRIPTION

Figure 1:
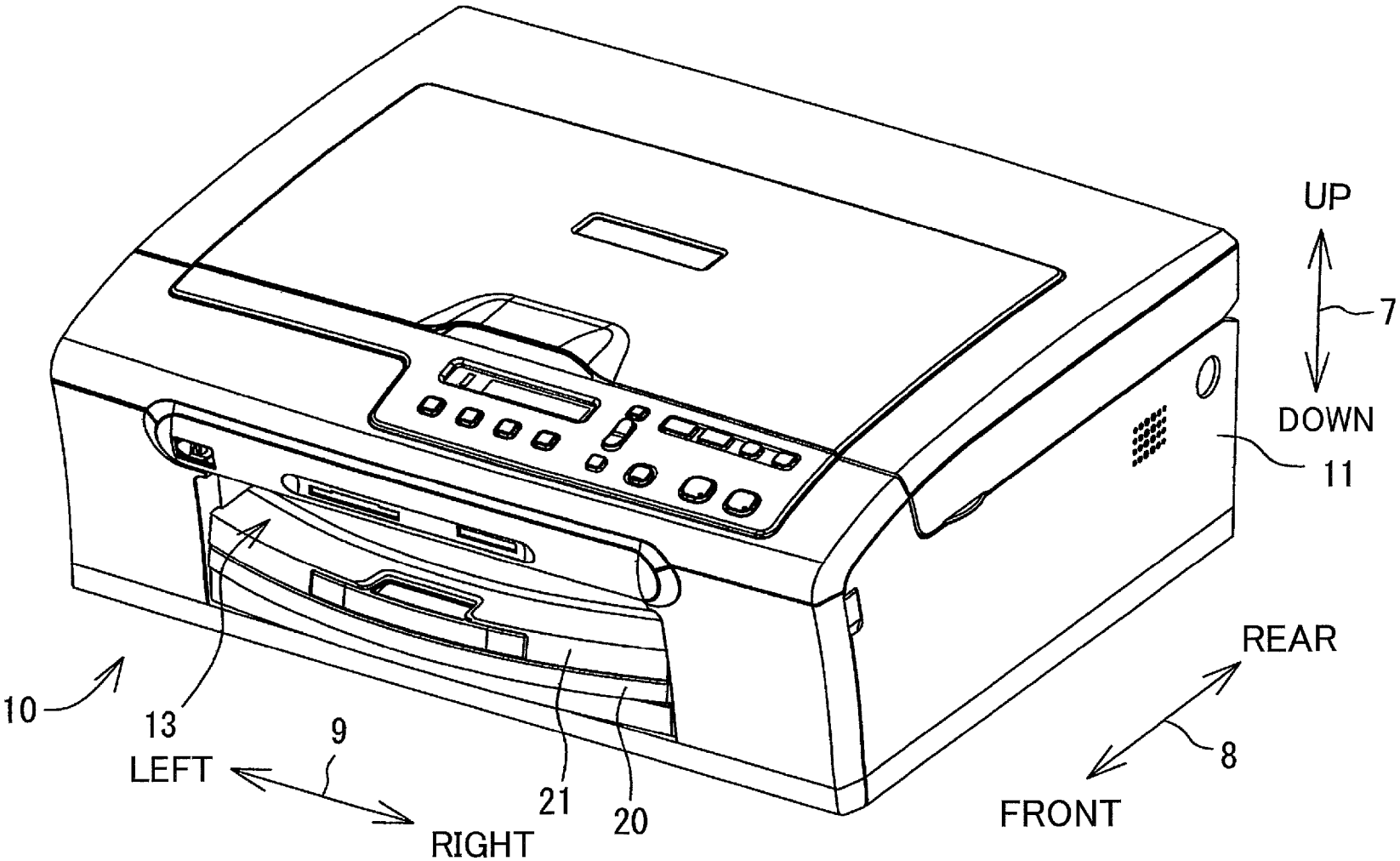
FIG. 1 is a perspective view of a multifunction peripheral according to an embodiment of the present invention.

Next, a multifunction peripheral 10 according to an embodiment of the present invention will be described while referring to the accompanying drawings. Directions used in the following description are defined as an up-down direction 7 aligned with the vertical dimension of the multifunction peripheral 10 when the multifunction peripheral 10 is in use (the state of the multifunction peripheral 10 in FIG. 1); a front-rear direction 8 aligned with the depth dimension of the multifunction peripheral 10, where the side of the multifunction peripheral 10 having an opening 13 (described later) formed therein is the side closest to (facing) the user; and a left-right direction 9 aligned with the width dimension of the multifunction peripheral 10, the left and right sides being defined based on the perspective of a user facing the front of the multifunction peripheral 10.

Overall Structure of the Multifunction Peripheral

As shown in FIG. 1, the multifunction peripheral 10 has a general rectangular parallelepiped shape with a low profile. The multifunction peripheral 10 is provided with a printing unit 11 in the lower section thereof. The multifunction peripheral 10 has various functions, including a facsimile function and a printer function. The printing unit 11 implements the printer function of the multifunction peripheral 10 according to an inkjet method of recording images on recording paper 12 (see FIG. 2). In the embodiment, the printing unit 11 has a function for recording images only on one side of the recording paper 12, but the printing unit 11 may be configured to record images on both sides of the recording paper 12.

Paper Tray

Figure 2:
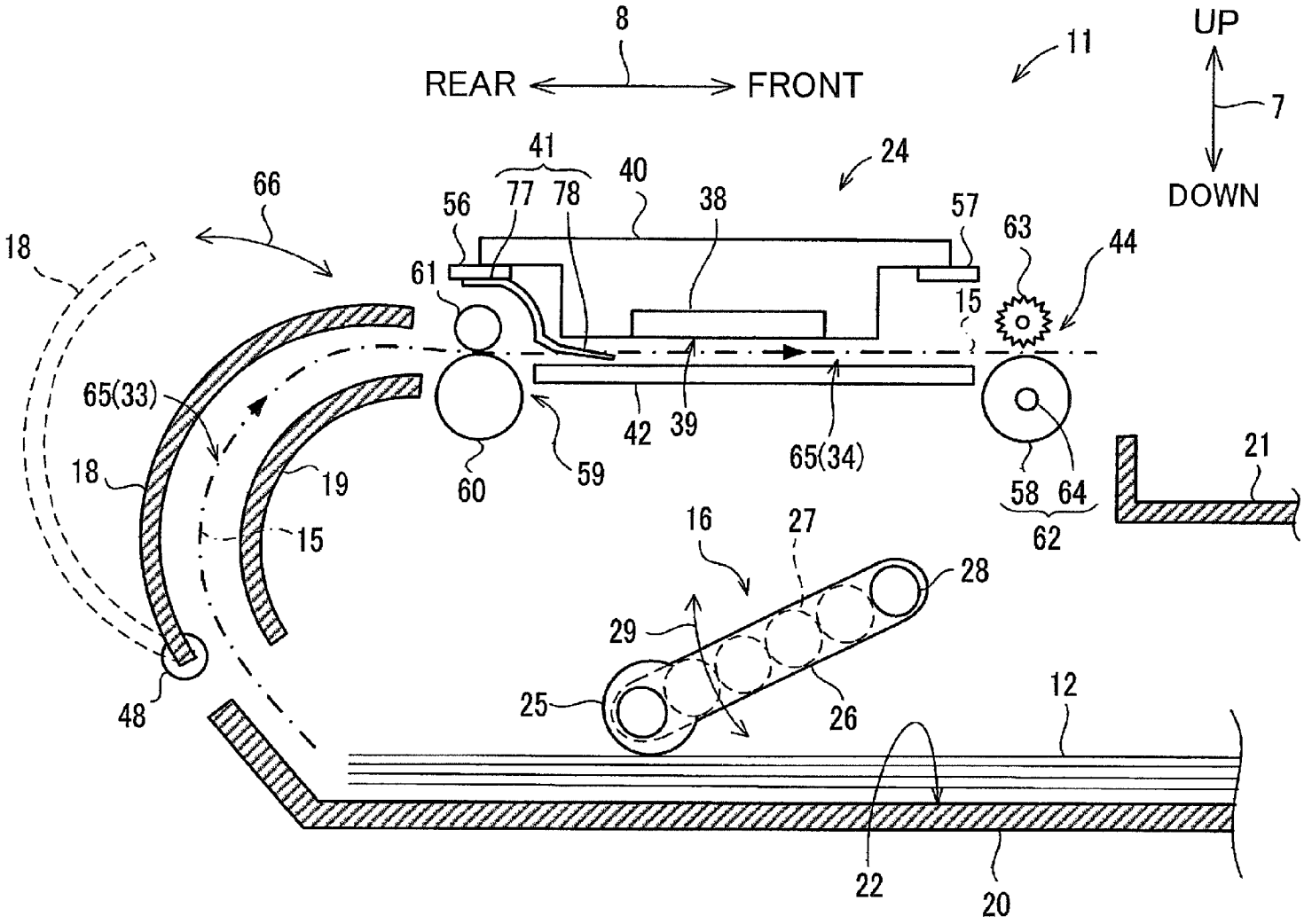
FIG. 2 is a cross-sectional side view schematically showing the internal configuration of a printing unit provided in the multifunction peripheral shown in FIG. 1.

As shown in FIG. 1, an opening 13 is formed in the front side of the printing unit 11. A paper tray 20 can be inserted into and removed from the printing unit 11 through the opening 13 by sliding the paper tray 20 along the front-rear direction 8. The paper tray 20 is a box-shaped member that has a bottom plate 22 for closing the bottom side, but is open on the top. As shown in FIG. 2, sheets of the recording paper 12 are stacked on top of the bottom plate 22 of the paper tray 20. A discharge tray 21 is supported on the top front side of the paper tray 20. The discharge tray 21 moves along the front-rear direction 8 together with the paper tray 20. Sheets of recording paper 12 are discharged onto the top surface of the discharge tray 21 after images have been recorded on the sheets by a recording unit 24 described later.

Sheet-Feeding Unit

As shown in FIG. 2, the printing unit 11 includes a sheet-feeding unit 16 disposed above the paper tray 20 when the paper tray 20 is inserted in the printing unit 11 and beneath the recording unit 24 described later. The sheet-feeding unit 16 includes a feeding roller 25, a feeding arm 26, and a drive transmission mechanism 27. The feeding roller 25 is rotatably supported on the distal end of the feeding arm 26. The base end of the feeding arm 26 is rotatably supported on a shaft 28, enabling the feeding arm 26 to pivot in directions indicated by arrows 29 in FIG. 2. By pivoting in this way, the feeding arm 26 can place the feeding roller 25 in contact with the paper tray 20 or the recording paper 12 supported on the paper tray 20, and can separate the feeding roller 25 from the same.

The transmission mechanism 27 has a plurality of intermeshed gears for transmitting a drive force from a conveying motor (not shown) to the feeding roller 25 in order to rotate the feeding roller 25. When rotated, the feeding roller 25 conveys the topmost sheet of recording paper 12 resting on the bottom plate 22 of the paper tray 20 onto a conveying path 65 described later. Another motor may be provided in addition to the conveying motor for driving the feeding roller 25 to rotate. While the transmission mechanism 27 includes a plurality of intermeshed gears in the embodiment, the transmission mechanism 27 may instead be configured of a belt looped about the shaft 28 and the shaft of the feeding roller 25, for example.

Conveying Path

As shown in FIG. 2, a conveying path 65 is defined to extend from the rear end of the paper tray 20. The conveying path 65 includes a curved section 33, and a straight section 34. The curved section 33 of the conveying path 65 extends from the rear end of the paper tray 20 while curving, such that the outer side of the curve faces rearward and the inner side faces forward. The straight section 34 of the conveying path 65 extends forward from the top end of the curved section 33 of the conveying path 65.

More specifically, the curved section 33 of the conveying path 65 includes an outer guide member 18 and an inner guide member 19 that confront each other with a prescribed gap formed therebetween. The outer guide member 18 forms the outer curved side of the curved section 33 of the conveying path 65, and the inner guide member 19 forms the inner curved side of the curved section 33 of the conveying path 65. Both the outer guide member 18 and inner guide member 19 are elongated in the left-right direction 9, i.e., the direction orthogonal to the surface of the drawing in FIG. 2. The recording unit 24 and a platen 42 that confront each other with a prescribed gap formed therebetween forms part of the straight section 34 of the conveying path 65 that is positioned below the recording unit 24. The outer guide member 18 and inner guide member 19 form part of the conveying path 65.

The feeding roller 25 conveys a sheet of recording paper 12 from the paper tray 20 along the curved section 33. Guided by the curved section 33, the sheet is conveyed upward along a U-shaped path until arriving at a pair of conveying rollers 59 described later. After the sheet becomes interposed between the conveying rollers 59, the conveying rollers 59 convey the sheet forward toward the recording unit 24 and into the straight section 34. As the sheet passes directly beneath the recording unit 24, the recording unit 24 records an image thereon. The sheet of recording paper 12 is conveyed forward along the front-rear direction 8 through the straight section 34 of the conveying path 65 and is discharged onto the discharge tray 21 after image recording is complete. A chain line arrow in FIG. 2 indicates a conveying direction 15 in which the sheets of recording paper 12 are conveyed along the path.

A shaft 48 is formed on the bottom end of the outer guide member 18. The shaft 48 enables the outer guide member 18 to rotate in the directions indicated by arrows 66 in FIG. 2. The outer guide member 18 forms the outer curved side of the curved section 33 when disposed in a first position indicated by solid lines in FIG. 2, and exposes the curved section 33 when disposed in a second position indicated by dashed lines in FIG. 2. Accordingly, by rotating the outer guide member 18 from its first position to its second position, the user of the multifunction peripheral 10 can extract sheets of recording paper 12 that have become jammed in the curved section 33.

Although the outer guide member 18 is configured to rotate in the embodiment, the outer guide member 18 may be configured to change positions in another manner. For example, the outer guide member 18 may be detachably mounted on the printing unit 11. In this case, the outer guide member 18 can be moved between a first position mounted on the printing unit 11 for forming the outer curved side of the curved section 33, and a second position removed from the printing unit 11 for exposing the curved section 33.

Recording Unit

Figure 3:
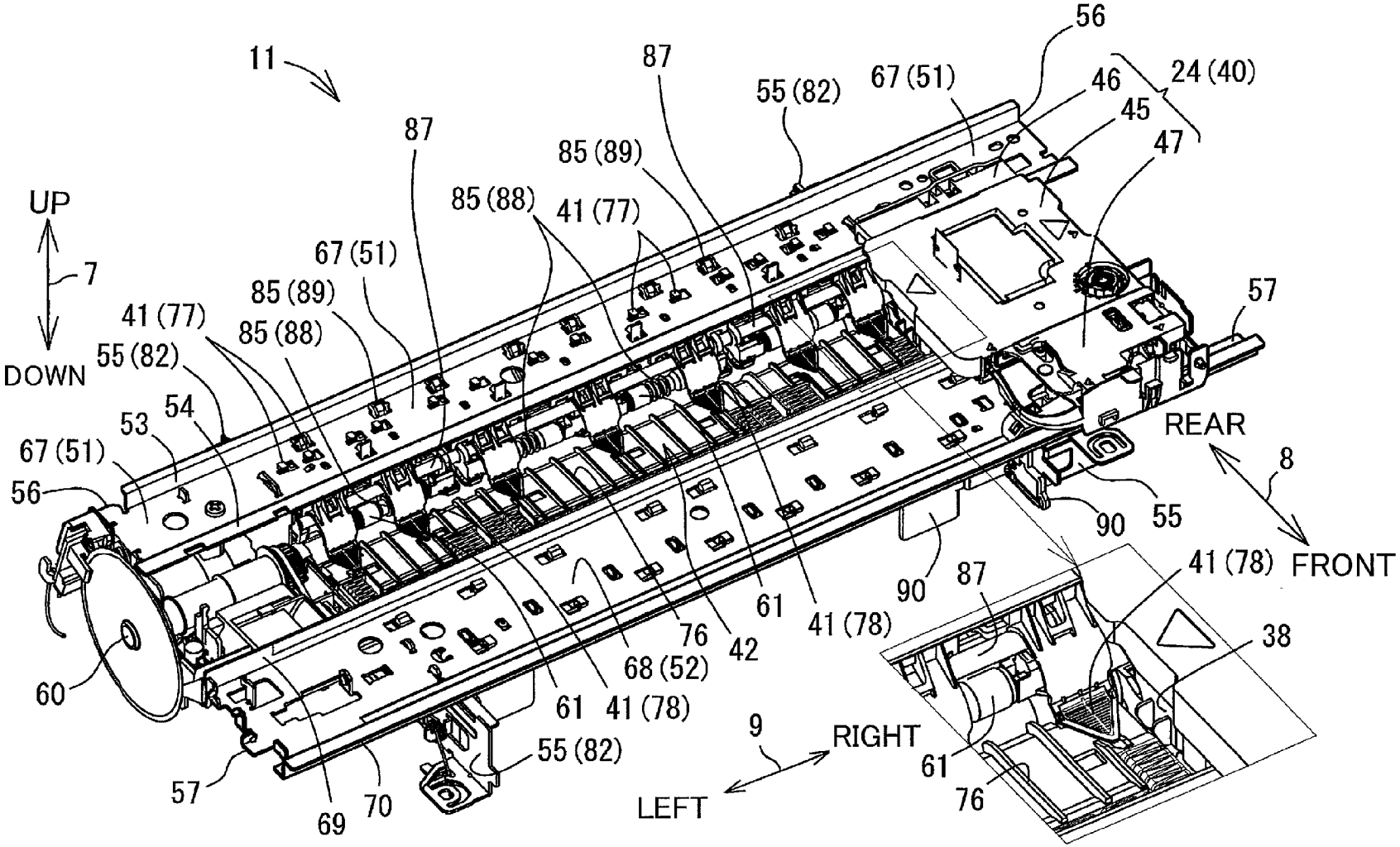
FIG. 3 is a perspective view showing a recording unit and guide rails, as well as members around the recording unit and guide rails in the printing unit.

As shown in FIG. 2, the recording unit 24 is disposed on the top side of the straight section 34. The platen 42 is disposed below the recording unit 24 and at a position confronting the recording unit 24 with a gap formed therebetween. The platen 42 has a plurality of ribs 76 arranged at intervals in the left-right direction 9 and elongated in the front-rear direction 8 as shown in FIG. 3. The platen 42 functions to support sheets of recording paper 12 conveyed through the straight section 34 of the conveying path 65 along the top edges of the ribs 76. The recording unit 24 includes a carriage 40, and a recording head 38.

The carriage 40 is supported on guide rails 56 and 57 so as to be capable of reciprocating in the left-right direction 9. The guide rails 56 and 57 are separated by a gap in the front-rear direction 8. The recording head 38 is supported in the carriage 40. Ink cartridges (not shown) supply ink to the recording head 38. Nozzles 39 are formed in the bottom surface of the recording head 38. The recording head 38 ejects ink droplets from the nozzles 39 toward the platen 42 as the carriage 40 moves along the left-right direction 9, thereby recording an image on a sheet of recording paper 12 supported on the platen 42 and being conveyed in the conveying direction 15.

Contact members 41 are provided on the upstream side of the nozzles 39 with respect to the conveying direction 15. The contact members 41 are arranged between adjacent ribs 76 formed on the platen 42 as will be described later with reference to FIG. 10. The proximal end of each contact member 41 is mounted on the guide rail 56, while the distal end of the contact member 41 contacts the top surface of a sheet of recording paper 12 conveyed through the straight section 34 of the conveying path 65 at a position in the conveying direction 15 between the nozzles 39 and a pair of conveying rollers 59 described later. The distal ends of the contact members 41 form the sheet of recording paper 12 into a continuous corrugated shape along the left-right direction 9 as will be described later with reference to FIG. 10. The corrugated shape is formed in the recording paper 12 due to the height relationships between the bottom edges of the contact members 41 and the top edges of the ribs 76 of the platen 42.

Conveying Rollers and Discharge Rollers

As shown in FIG. 2, the pair of conveying rollers 59 is provided on the straight section 34 of the conveying path 65 upstream of the recording head 38 in the conveying direction 15. A pair of discharge rollers 44 is disposed on the straight section 34 of the conveying path 65 downstream of the recording head 38 in the conveying direction 15.

The conveying rollers 59 include a conveying roller 60 disposed on the lower side of the straight section 34, and pinch rollers 61 disposed on the upper side of the straight section 34 in confrontation with the conveying roller 60. As shown in FIG. 3, the conveying roller 60 is a columnar-shaped member with a hollow center and is elongated in the left-right direction 9. A plurality of the pinch rollers 61 is provided at intervals along the left-right direction 9. The pinch rollers 61 are pressed by elastic members against the conveying roller 60.

Figure 9B:
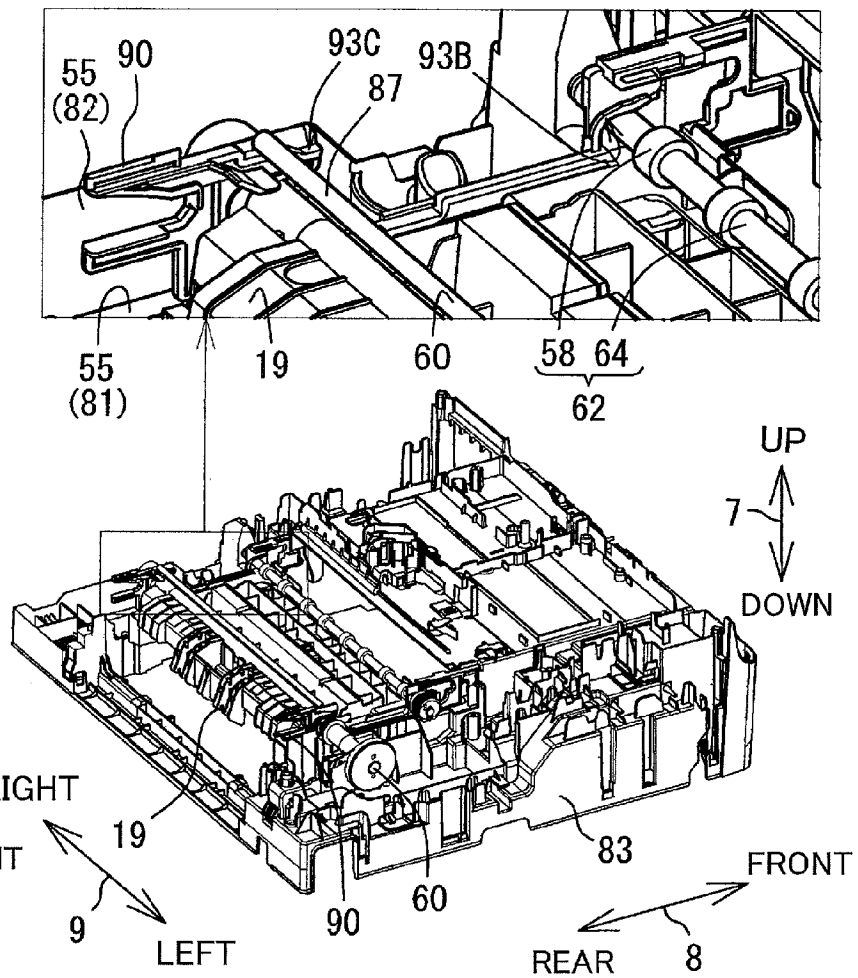
Figure 9A:
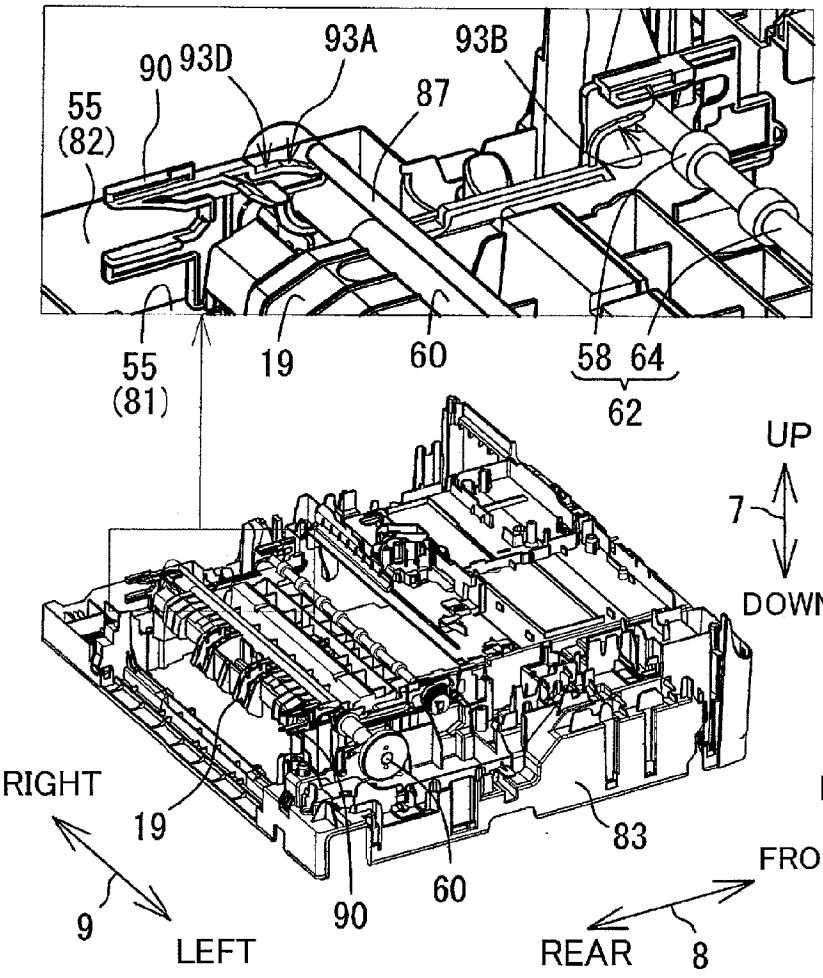

The discharge rollers 44 include a discharge roller 62 disposed on the lower side of the straight section 34, and spur gears 63 disposed on the upper side of the straight section 34 in confrontation with the discharge roller 62. The discharge roller 62 further includes a shaft 64 oriented in the left-right direction 9, and roller parts 58 mounted around the shaft 64 at intervals along the left-right direction 9 as shown in FIG. 9A. A plurality of the spur gears 63 is provided at intervals in the left-right direction 9. The spur gears 63 are positioned to oppose the roller parts 58 of the discharge roller 62. The spur gears 63 are pressed by elastic members against the roller parts 58 of the discharge roller 62.

The conveying roller 60 and discharge roller 62 are driven to rotate by a drive force transmitted from the conveying motor (not shown). When the conveying roller 60 rotates, a sheet of recording paper 12 interposed between the conveying rollers 59 is conveyed over the platen 42 in the conveying direction 15 by the conveying rollers 59. When the discharge roller 62 rotates, a sheet of recording paper 12 interposed between the discharge rollers 44 is conveyed further downstream in the conveying direction 15 by the discharge rollers 44.

Guide Rails

Figure 4:
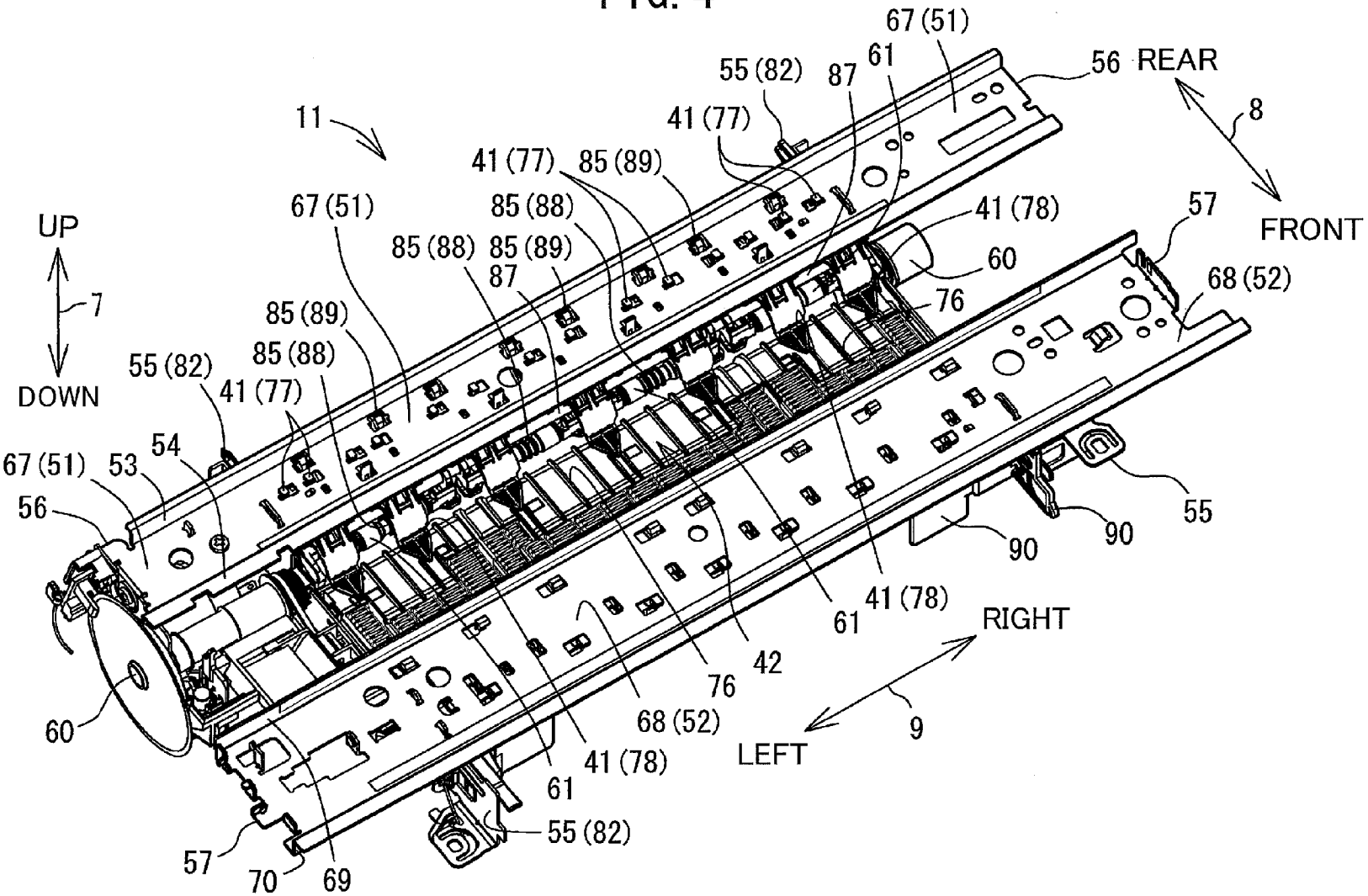
FIG. 4 is a perspective view equivalent to FIG. 3, from which showing of the recording unit is omitted.
Figure 5:
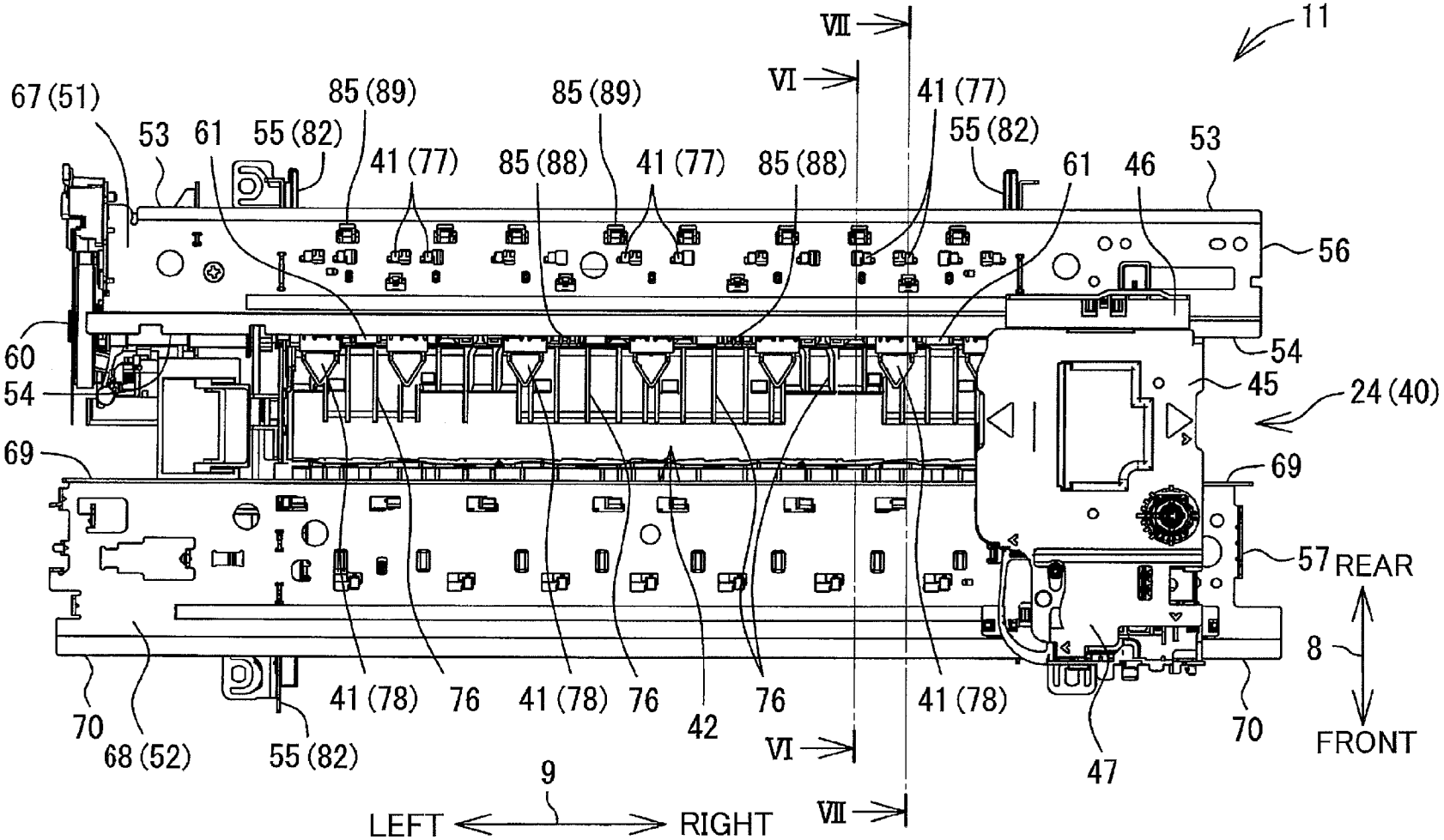
FIG. 5 is a plan view showing the recording unit and guide rails, as well as members around the recording unit and guide rails in the printing unit.

As shown in FIGS. 3 through 5, the guide rails 56 and 57 (as an example of a support frame) are respectively provided with support parts 67 and 68. The dimensions of the support parts 67 and 68 in the front-rear direction 8 and left-right direction 9 are greater than their dimensions in the up-down direction 7, while their dimensions in the left-right direction 9 are greater than their dimensions in the front-rear direction 8. That is, each of the support parts 67 and 68 is a flat plate-shaped member that extends in both the front-rear direction 8 (i.e., along the conveying direction 15 at the straight section 34 of the conveying path 65) and the left-right direction 9 (i.e., the width direction orthogonal to the conveying direction 15 and also the direction in which the carriage 40 moves).

In the embodiment, the guide rails 56 and 57 are bent upward at both front and rear edges of the respective support parts 67 and 68. Specifically, the guide rail 56 includes a rear bent part 53 (as an example of a bent part) bent upward along the rear edge of the support part 67, and a front bent part 54 (as an example of a bent part) bent upward along the front edge of the support part 67. Similarly, the guide rail 57 includes a rear bent part 69 bent upward along the rear edge of the support part 68, and a front bent part 70 bent upward along the front edge of the support part 68. While the guide rails 56 and 57 are preferably bent along both front and rear edges of the respective support parts 67 and 68, the guide rails 56 and 57 may be formed by bending only one of the front and rear edges along the respective support parts 67 and 68 instead. That is, at least one edge on each of the guide rails 56 and 57 should be bent, and that edge should be either the upstream edge in the conveying direction 15 (rear edge) or the downstream edge (front edge). As an alternative, the guide rails 56 and 57 could be bent downward rather than upward.

Figure 6:
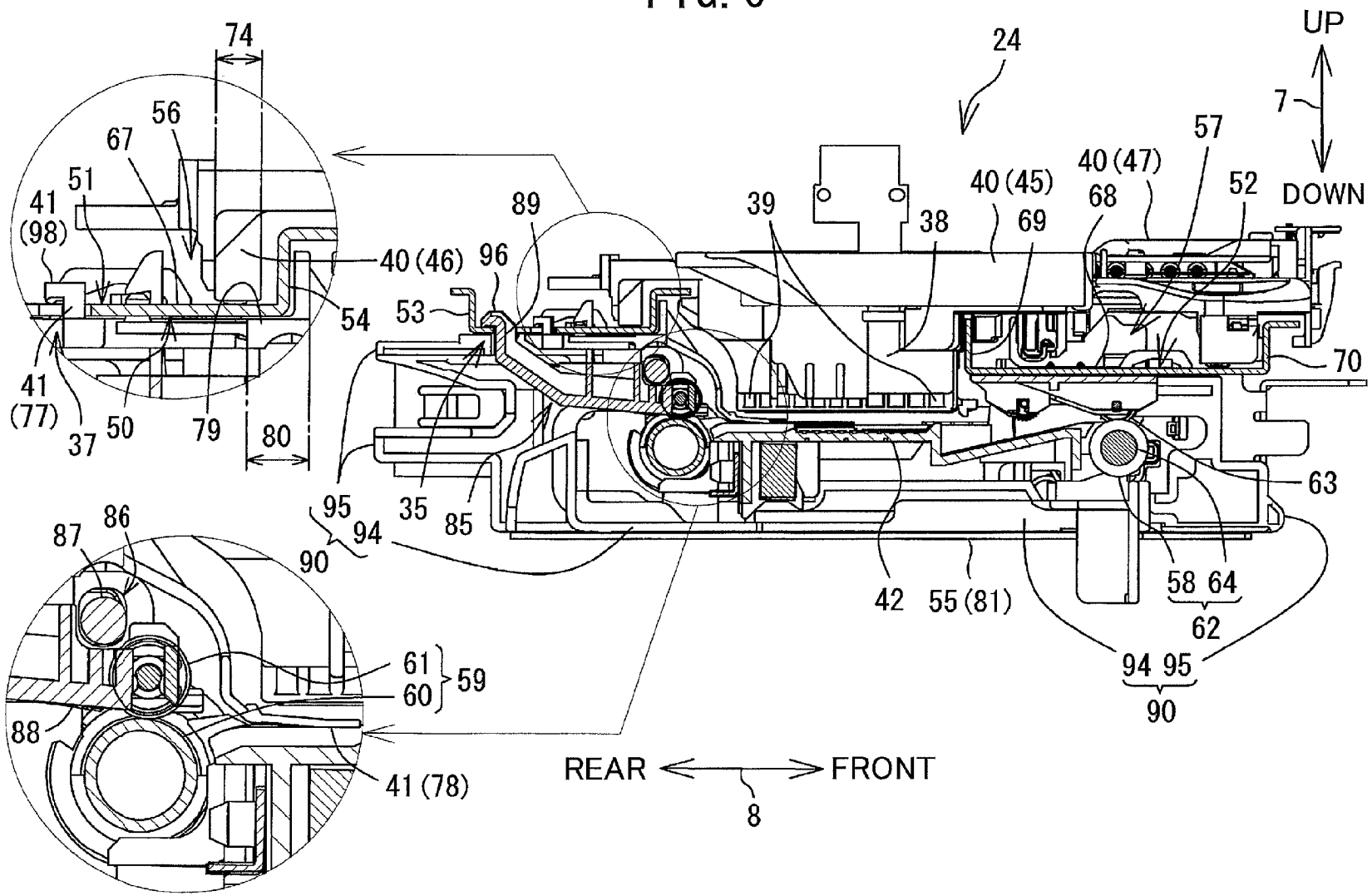
FIG. 6 is a cross-sectional side view taken along a line VI-VI in FIG. 5.
Figure 7:
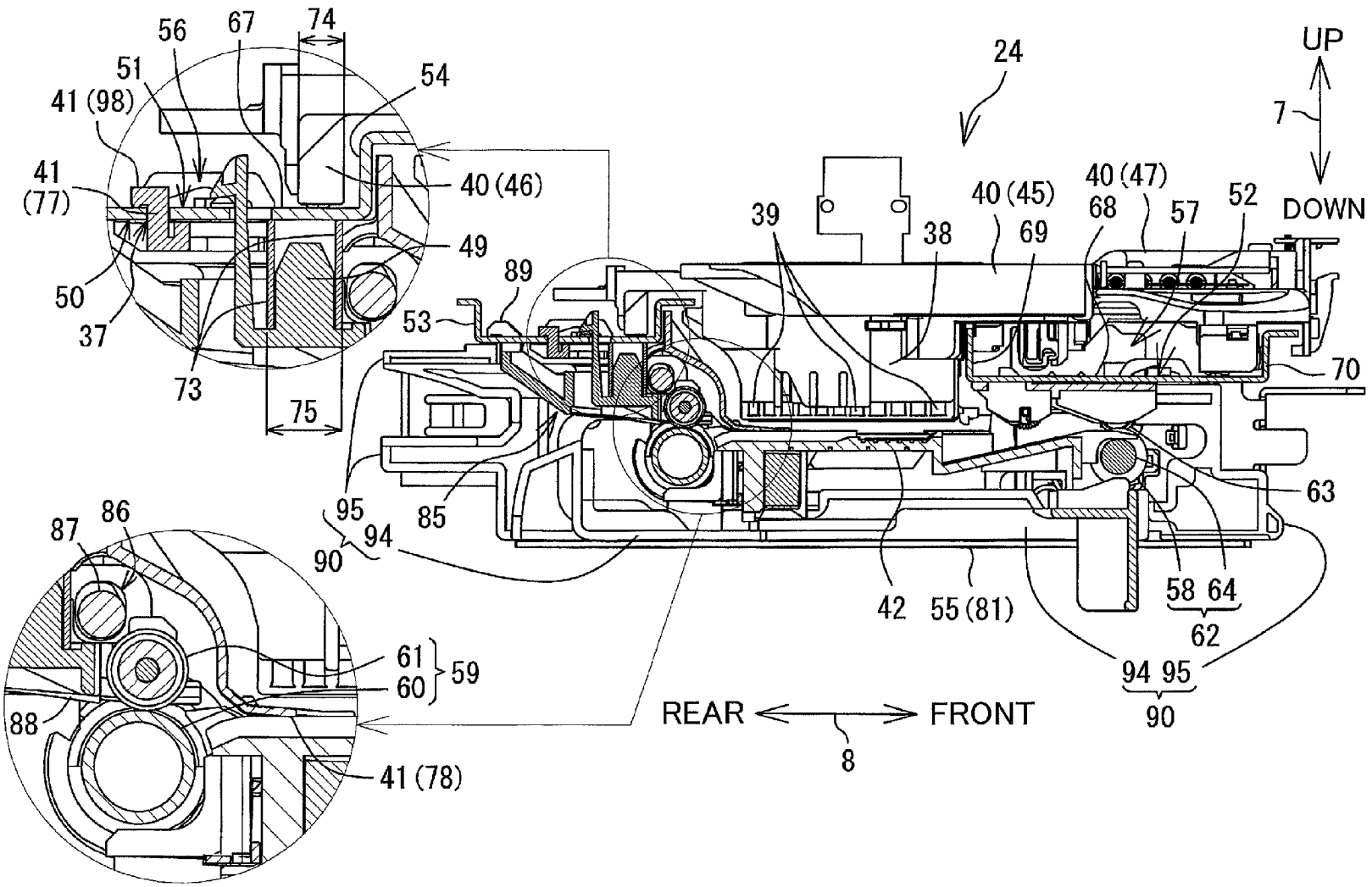
FIG. 7 is a cross-sectional side view taken along a line VII-VII in FIG. 5.

As shown in FIG. 3, the carriage 40 straddles the two guide rails 56 and 57. The carriage 40 includes a carriage body 45, a rear protruding part 46 that protrudes rearward from the carriage body 45, and a front protruding part 47 that protrudes forward from the carriage body 45. As shown in FIGS. 6 and 7, the bottom of the rear protruding part 46 contacts a top surface 51 of the support part 67 along its front edge, i.e., along the rear side of the front bent part 54. Thus, the bottom of the rear protruding part 46 contacts the top surface 51 of the support part 67 at a position near to the front bent part 54. Similarly, the bottom of the front protruding part 47 contacts a top surface 52 of the support part 68 along its front edge, i.e., along the rear side of the front bent part 70. Thus, the bottom of the front protruding part 47 contacts the top surface 52 of the support part 68 at a position near to the front bent part 70.

A belt mechanism (not shown) well known in the art is provided on the top surface 52 of the guide rail 57. The belt mechanism includes pulleys disposed on the top surface 52 at both left and right ends of the support part 68, and a belt looped around the pulleys. The belt is coupled to the front protruding part 47 of the carriage 40 and a carriage drive motor (not shown) that provides a drive force to the carriage 40. When activated, the carriage drive motor transmits a drive force to the carriage 40 via the belt mechanism for driving the carriage 40 in the left-right direction 9. Through this drive force, the carriage 40 is reciprocated in the left-right direction 9, i.e., along the width dimension of the recording paper 12. Thus, the carriage 40 is supported on the top surfaces 51 and 52 (as an example of a first surface) of the support parts 67 and 68 in the guide rails 56 and 57 such that the carriage 40 can move along the left-right direction 9.

As shown in FIGS. 6 and 7, the pinch roller 61 described above is disposed below the guide rail 56. Hence, the pinch roller 61 is positioned on a bottom surface 50 side of the support part 67. The bottom surface 50 (as an example of a second surface) is on the opposite side from the top surface 51 with respect to the up-down direction 7 (as an example of an orthogonal direction), which is orthogonal to both the front-rear direction 8 (i.e., the conveying direction 15 at the straight section 34 of the conveying path 65) and the left-right direction 9. As described above, the conveying roller 60 is disposed below the pinch roller 61 and in confrontation with the same. Hence, the conveying roller 60 is disposed opposite to the guide rail 56 relative to the pinch roller 61, and confronts the pinch roller 61.

Roller Holder

As shown in FIGS. 6 and 7, roller holders 85 are disposed below the guide rail 56, i.e., on the bottom surface 50 side of the support part 67 with respect to the up-down direction 7. The roller holders 85 rotatably support the pinch rollers 61. The roller holders 85 are disposed at positions corresponding to the pinch rollers 61. Specifically, as illustrated in FIGS. 3 and 4, the roller holders 85 are spaced at intervals in the left-right direction 9 so as to be positioned in opposition to the pinch rollers 61. In the embodiment, each roller holder 85 supports one pinch roller 61, but the roller holders 85 may be configured to support two or more pinch rollers 61 individually. Hence, each roller holder 85 supports at least one of the plurality of pinch rollers 61.

As shown in FIGS. 6 and 7, each roller holder 85 rotatably supports the pinch roller 61 at a front end 88 of the roller holder 85. A protruding part 89 (as an example of a first protruding part) protrudes upward from the rear end of the roller holder 85. The distal end of the protruding part 89 is engaged with the guide rail 56. In this manner, the roller holders 85 are disposed at the guide rail 56. However, the roller holders 85 may be engaged with a member other than the guide rail 56.

As shown in FIGS. 6 and 7, openings 35 (as an example of a first opening) are formed in the support part 67 of the guide rail 56. The dimensions of the openings 35 are approximately equal to the dimensions of the protruding parts 89 in the front-rear direction 8 and left-right direction 9. A projection 96 (as an example of a first engaging part) is formed on the distal end of each protruding part 89 and protrudes rearward therefrom. The dimensions of the projections 96 in the front-rear direction 8 and left-right direction 9 are greater than the corresponding dimensions of the openings 35. Accordingly, in order to pass the protruding part 89 upward through the corresponding opening 35 formed in the support part 67 of the guide rail 56, the projection 96 must be inserted through the opening 35 at an angle, or an opening larger than the projection 96 must be formed adjacent to and continuously from the left or right side of the opening 35. In the latter case, the projection 96 is first inserted through the larger opening, and then the roller holder 85 is slid in the left-right direction 9.

After inserting the protruding parts 89 into the corresponding openings 35, as described above, the projections 96 are in contact with the top surface 51 of the support part 67 from above. In other words, the projections 96 are engaged with the top surface 51 of the support part 67. Further, this engagement region in which the projections 96 are engaged with the top surface 51 of the support part 67 is positioned at the rear of a first region 74 described later in which the rear protruding part 46 of the carriage 40 contacts the top surface 51 of the support part 67. In other words, the engagement region and the first region 74 are at different positions relative to the conveying direction 15.

As described above, the roller holders 85 are attached to the guide rail 56 by the respective protruding parts 89 and their center portions in the front-rear direction 8. Each roller holder 85 is capable of pivoting about its rear end portion, i.e., the engagement region of the projections 96, with respect to the conveying direction 15, when a sheet of recording paper 12 becomes interposed between the conveying rollers 59, or movable members 90 described later move the pinch rollers 61 in the up-down direction 7, applying pressure to the roller holders 85.

A hole 86 (as an example of a hole) is formed in each roller holder 85, penetrating the roller holder 85 in the left-right direction 9. A shaft 87 described later aligned in the left-right direction 9 is inserted through all holes 86. As shown in FIG. 9A, the left and right ends of the shaft 87 are supported by the movable members 90 described later.

Coil Springs

As shown in FIG. 7, coil springs 73 are mounted on top of the roller holders 85. The coil springs 73 (as an example of an urging member) are for pressing the pinch rollers 61 against the conveying roller 60. A plurality of the coil springs 73 is provided at intervals in the left-right direction 9. Each of the coil springs 73 is positioned to correspond to one of the roller holders 85. A protrusion 49 is provided on each roller holder 85 forward of the protruding part 89. The protrusion 49 protrudes upward from the roller holder 85. Each coil spring 73 is wound around the protrusion 49 of the corresponding roller holder 85, with the bottom end of the coil spring 73 contacting the roller holder 85 and the top end contacting the bottom surface 50 of the support part 67 on the opposite side from the top surface 51. When placed around the protrusion 49, the coil spring 73 is compressed to a length shorter than its natural length. Accordingly, the coil spring 73 urges the corresponding roller holder 85 downward so as to press the pinch roller 61 against the conveying roller 60.

FIG. 7 shows a first region 74 in the front-rear direction 8 at which the rear protruding part 46 of the carriage 40 contacts the top surface 51 of the support part 67 of the guide rail 56, and a second region 75 in the front-rear direction 8 at which the top ends of the coil springs 73 contact the bottom surface 50 of the guide rail 56. The first region 74 overlaps the second region 75 with respect to the front-rear direction 8, i.e., the conveying direction 15. In other words, the first region 74 in which the carriage 40 contacts the top surface 51 of the support part 67 overlaps the second region 75 in which the coil springs 73 contact the bottom surface 50 of the support part 67 with respect to the conveying direction 15.

Further, the top ends of the coil springs 73 contact the front end portion of the bottom surface 50 of the guide rail 56. As described above, the rear protruding part 46 of the carriage 40 contacts the front end portion of the top surface 51 of the support part 67. The front end portion of the top surface 51 is also near the rear side of the front bent part 54. Thus, from the above description, the first region 74 and second region 75 are both positioned at the front end portion of the guide rail 56 and, hence, near the rear side of the front bent part 54. Note that the first region 74 and second region 75 may instead both be regions on the rear end portion of the guide rail 56, i.e., near the front side of the rear bent part 53. In other words, the region of the support part 67 in which the first region 74 and second region 75 overlap each other with respect to the conveying direction 15 may be offset from the center region of the guide rail 56 with respect to the conveying direction 15 toward either the front bent part 54 or the rear bent part 53.

Contact Members

As shown in FIG. 2, the contact members 41 are provided upstream, in the conveying direction 15, of the nozzles 39 formed in the recording head 38. As shown in FIGS. 3 and 5, a plurality of the contact members 41 is disposed at intervals in the left-right direction 9. A proximal end 77 of each contact member 41 is engaged with the guide rail 56. Hence, the contact members 41 are disposed at the guide rail 56.

As shown in FIGS. 6 and 7, openings 37 (as an example of a second opening) are formed in the support part 67 of the guide rail 56. The proximal ends 77 (as an example of a second protruding part) of the contact members 41 protrude upward from the body of the contact members 41. The proximal ends 77 have dimensions in the front-rear direction 8 and left-right direction 9 substantially equal to the corresponding dimensions of the openings 37. A protrusion 98 (as an example of a second engaging part) is formed on the distal end of the proximal end 77 and protrudes rearward therefrom. The dimensions of the protrusion 98 in the front-rear direction 8 and left-right direction 9 are greater than the corresponding dimensions of the openings 37. Therefore, in order to insert the proximal end 77 upward through the corresponding opening 37 formed in the support part 67, the protrusion 98 must be inserted into the opening 37 at an angle, or an opening larger than the protrusion 98 must be formed adjacent to and continuously from the left or right side of the opening 37. In the latter case, the protrusion 98 is inserted through the larger opening, and subsequently the contact member 41 is moved in the left-right direction 9.

When the proximal end 77 is inserted into the opening 37, as described above, the protrusion 98 is in contact with the top surface 51 of the support part 67 from above. In other words, the protrusion 98 is engaged with the top surface 51 of the support part 67. In this state, the engagement region in which the protrusions 98 is engaged with the top surface 51 of the support part 67 is further rearward than the first region 74. That is, this engagement region and the first region 74 are at different positions with respect to the conveying direction 15.

Each of the contact members 41 extends forward from its proximal end 77 while curving downward. A distal end 78 (as an example of a first contact part) on each contact member 41 extends forward from the distal end of the curved portion (more precisely, extends forward with a slight downward slope). The bottom surface of the distal end 78 of the contact member 41 contacts the top surface of a sheet of recording paper 12 conveyed along the conveying path 65 (i.e., the surface of the sheet that contacts the pinch rollers 61) at a position between the conveying rollers 59 and the nozzles 39 in the conveying direction 15.

As shown in FIGS. 3 through 5, a plurality of the ribs 76 is formed on the top surface of the platen 42. The ribs 76 are erected upward from the top surface of the platen 42. A plurality of the ribs 76 is arranged at intervals in the left-right direction 9. Each rib 76 is disposed at a position between neighboring contact members 41 in the left-right direction 9. The ribs 76 are elongated in the front-rear direction 8. Hence, sheets of recording paper 12 conveyed over the platen 42 are supported on the top edges of the ribs 76 in the embodiment.

Figure 10:
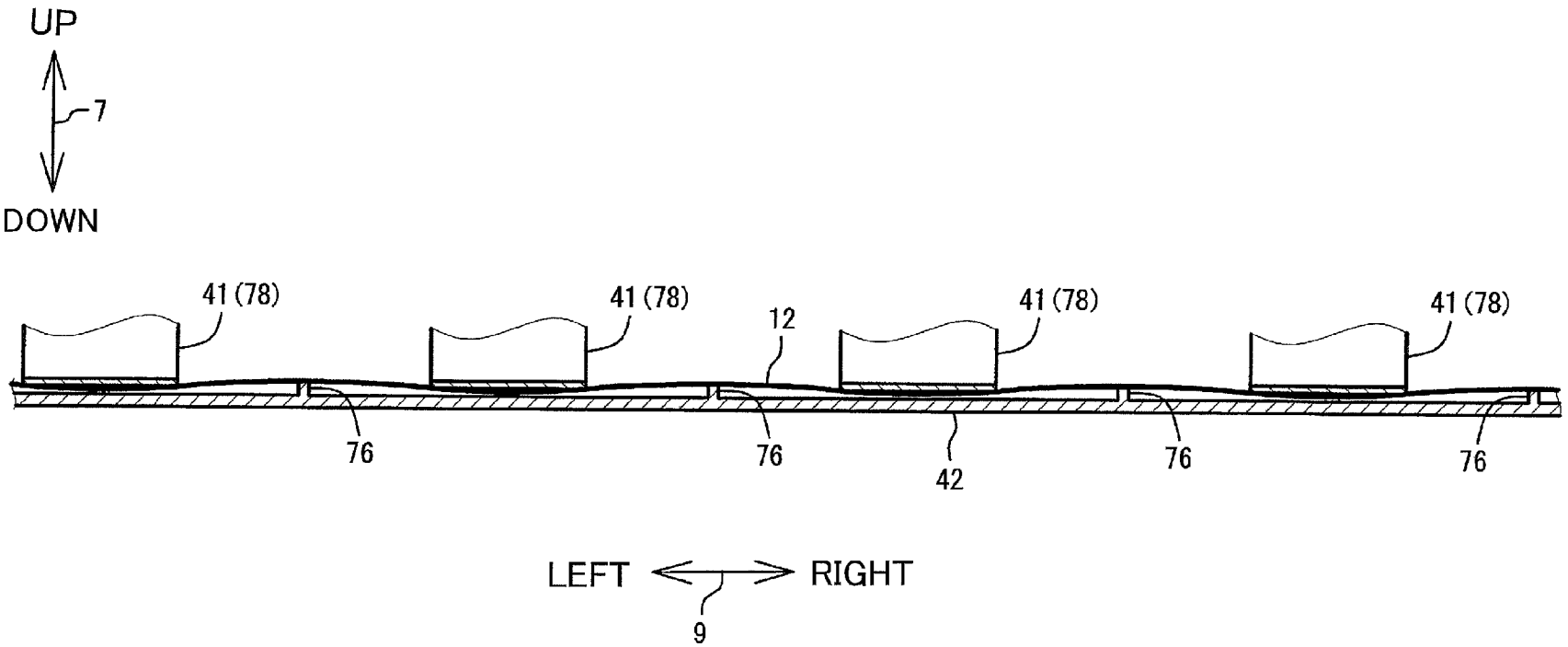
FIG. 10 is a sectional view showing part of a platen, contact members, and a sheet of recording paper.

The top edges of the ribs 76 are positioned higher than the bottom edges of the contact members 41 (and specifically the bottom edges of the distal ends 78 of the contact members 41). Consequently, a sheet of recording paper 12 conveyed along the conveying path 65 beneath the contact members 41 is formed by the contact members 41 and ribs 76 into a corrugated shape that undulates continuously in the left-right direction 9, as illustrated in FIG. 10. That is, the contact members 41 contact the top surface of the sheet of recording paper 12 to produce a corrugated shape in the sheet in cooperation with the ribs 76.

As described above, the proximal ends 77 of the contact members 41 are attached to the guide rail 56, while the distal ends 78 are attached to no members. With this configuration, the contact members 41 can pivot about the proximal ends 77 so that the distal ends 78 move vertically. When a sheet of recording paper 12 conveyed along the conveying path 65 contacts the contact members 41, the contact members 41 pivot upward so that the distal ends 78 are raised a distance equivalent to the thickness of the sheet.

As shown in FIG. 6, a protruding part 79 (as an example of a second contact part) is upwardly erected from the top surface of each contact member 41 at a position forward of the proximal end 77 and rearward of the curved portion. The protruding part 79 is formed at a position confronting the bottom surface 50 of the guide rail 56 and thereby restricts upward movement (pivoting in the embodiment) of the contact member 41. In other words, when the protruding part 79 of the contact member 41 contacts the bottom surface 50 of the guide rail 56, the contact member 41 cannot pivot any further upward.

As shown in FIG. 6, the first region 74 described earlier is a region in the front-rear direction 8 at which the rear protruding part 46 of the carriage 40 contacts the top surface 51 of the guide rail 56. In addition, FIG. 6 shows a third region 80 in the front-rear direction 8 at which the tops of the protruding parts 79 formed on the contact members 41 contact the bottom surface 50 of the guide rail 56. As shown, the first region 74 overlaps the third region 80 with respect to the front-rear direction 8, i.e., the conveying direction 15. In other words, the first region 74 in which the carriage 40 contacts the top surface 51 and the third region 80 in which the protruding parts 79 of the contact members 41 contact the bottom surface 50 overlap with respect to the conveying direction 15.

Movable Members

As shown in FIGS. 3, 4, and 9, a pair of movable members 90 is provided outside of the conveying path 65, with one outside the right edge of the conveying path 65 and the other outside the left edge. Each of the movable members 90 is supported on one of a pair of side frames 55. The side frames 55 are metal members having a bent plate shape. Specifically, each side frame 55 includes a bottom part 81 (see FIGS. 6 and 7), and a side part 82. As shown in FIG. 9A, a base frame 83 is provided underneath the side frames 55. The base frame 83 forms the lower framework of the printing unit 11. The side frames 55 are supported on the base frame 83 by fastening the bottom parts 81 to the base frame 83 with screws.

The left and right ends of the guide rails 56 and 57 are supported on the corresponding side frames 55. Additionally, the left and right ends of the conveying roller 60 and the left and right ends of the shaft 64 of the discharge roller 62 are rotatably supported in the corresponding side frames 55. The left and right ends of the shaft 64 are also inserted through openings 72 formed in the corresponding movable members 90 (see FIGS. 8A and 8B). As will be described later, the shaft 64 moves in the up-down direction 7 along with movement of the movable members 90.

When supported on the side frames 55, the bottom surface of each movable member 90 contacts the bottom part 81 of the corresponding side frame 55, the side surface of each movable member 90 contacts the side part 82 of the corresponding side frame 55, and the top surface of each movable member 90 contacts the bottom surfaces of the guide rails 56 and 57. With this configuration, the guide rails 56 and 57 position the top surface of each movable member 90, the side frame 55 positions the side surface of the corresponding movable member 90, and the side frame 55 positions the bottom surface of the corresponding movable member 90.

The movable members 90 are capable of moving in the front-rear direction 8 along the top surfaces of the bottom parts 81 of the side frames 55. Specifically, the movable members 90 can move between a first position shown in FIG. 9A and a second position shown in FIG. 9B that is further forward of the first position.

Figure 8B:
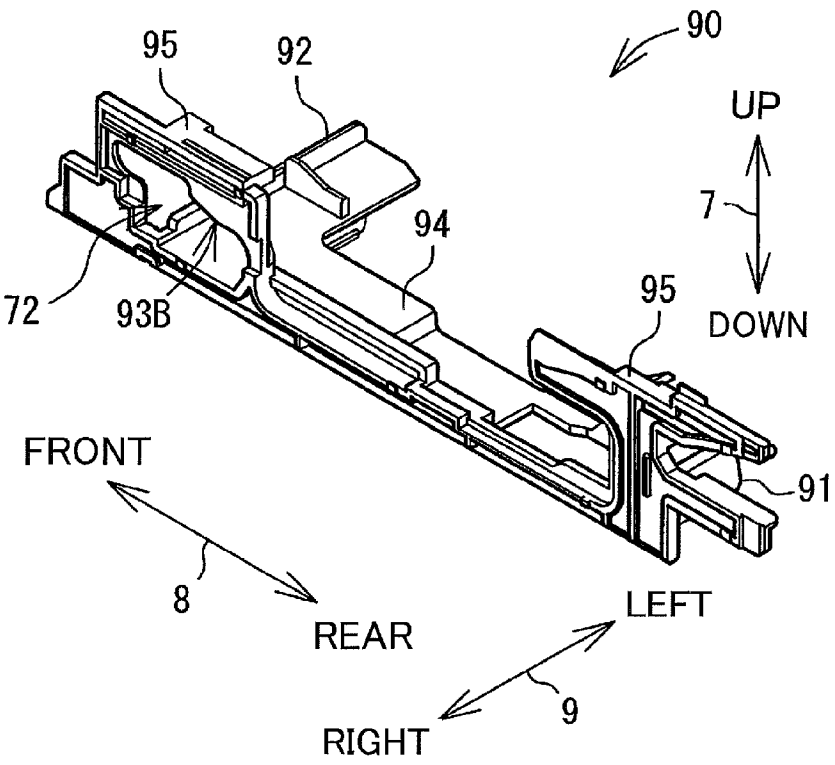
FIG. 8B is a perspective view of the movable member viewed from a right-and-rear side of the movable member.
Figure 8A:
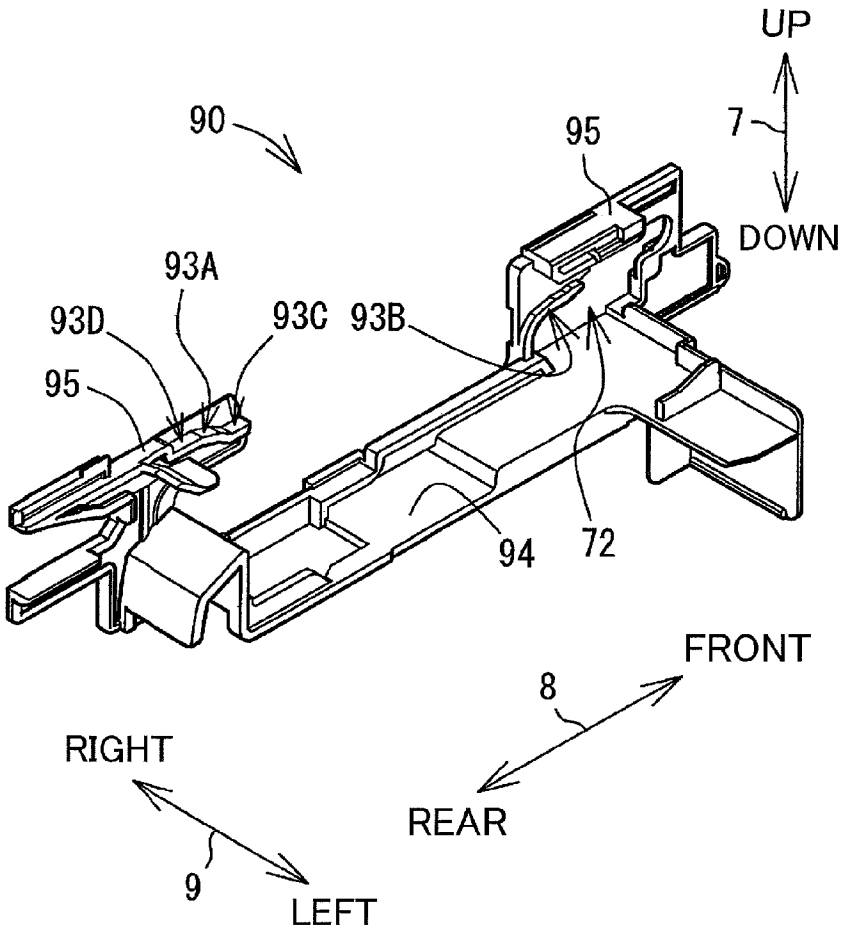
FIG. 8A is a perspective view of a movable member viewed from a left-and-rear side of the movable member.

As shown in FIGS. 8A and 8B, each movable member 90 includes a first plate part 94 that extends in the front-rear direction 8 and left-right direction 9 while having a larger dimension in the front-rear direction 8 than the dimension in the left-right direction 9; second plate parts 95 that are erected upward from the front and rear ends of the first plate part 94; and contact parts 93 (as an example of a guide part) formed on the second plate parts 95.

The contact parts 93 include a first contact part 93A that contacts and supports an end of the shaft 87 (as an example of an elongated member) from below, and a second contact part 93B that contacts an end of the shaft 64 of the discharge roller 62 from above. The contact parts 93 have sloped surfaces that slope in a direction intersecting the front-rear direction 8, i.e., the direction in which the movable members 90 move. More specifically, the first contact part 93A slopes downward from its rear side to its front side, while the second contact part 93B slopes upward from its rear side to its front side. The contact parts 93 further include a first level surface 93C formed continuously from the front end of the first contact part 93A for supporting the shaft 87 when the movable member 90 is in the first position; and a second level surface 93D formed continuously from the rear end of the first contact part 93A for supporting the shaft 87 when the movable member 90 is in the second position.

As shown in FIG. 9A, the first level surfaces 93C of the movable members 90 support the shaft 87 when the movable members 90 are in the first position. At this time, the urging force of the coil springs 73 (see FIG. 7) press the pinch rollers 61 against the conveying roller 60. Further, the shaft 64 of the discharge roller 62 is separated from the second contact parts 93B. In this state, the spur gears 63 are pressed against the roller parts 58 of the discharge roller 62.

When the user of the multifunction peripheral 10 pulls the movable members 90 forward from the first position, the shaft 87 separates from the first level surfaces 93C and contacts the first contact parts 93A. As the user continues to pull the movable members 90 further forward, the shaft 87 gradually moves upward while being guided on the first contact parts 93A. When the movable members 90 arrive in the second position, the shaft 87 separates from the first contact parts 93A against the urging force of the coil springs 73 and becomes supported on the second level surfaces 93D, as illustrated in FIG. 9B. As the shaft 87 is pushed upward during this operation, the roller holders 85 rotate upward, separating the pinch rollers 61 from the conveying roller 60.

In addition, as the movable members 90 move forward from the first position, the shaft 64 of the discharge roller 62 contacts the second contact parts 93B. As the movable members 90 move further forward, the shaft 64 is pushed downward by the second contact parts 93B positioned thereabove. When the movable members 90 arrive in the second position, the shaft 64 is in contact with the rear ends of the second contact parts 93B, i.e., the lowest part of the second contact parts 93B, as illustrated in FIG. 9B. Accordingly, movement of the shaft 64 in the above operation displaces the discharge roller 62 downward and away from the spur gears 63.

When the user of the multifunction peripheral 10 grips the grip parts 92 and pushes the movable members 90 rearward from the second position, the shaft 87 passes from the second level surfaces 93D via the first contact parts 93A to the first level surfaces 93C as the movable members 90 move from the second position to the first position, and is thereafter supported on the first level surfaces 93C. Since the shaft 87 moves downward in this operation, the roller holders 85 rotate downward, thereby placing the pinch rollers 61 into contact with the conveying roller 60. In addition, the shaft 64 separates from the second contact parts 93B, allowing the discharge roller 62 to move upward and contact the spur gears 63.

By contacting the shaft 87 and guiding the vertical movement of the shaft 87, the contact parts 93 cause the roller holders 85 to pivot (i.e., move) in the up-down direction 7 (as an example of a movement direction). Further, when the movable members 90 move from the first position to the second position, the shaft 87 moves upward away from the rotational center of the conveying roller 60. As a result, the distance in the up-down direction 7 between the shaft 87 and the rotational center of the conveying roller 60 (i.e., the axis of the conveying roller 60) when the movable members 90 are in the second position (as an example of a second distance) is greater than the distance when the movable members 90 are in the first position (as an example of a first distance). The movable members 90 are not limited to the structure described above, provided that the movable members 90 can move the conveying rollers 59 close to and away from each other, and can move the discharge rollers 44 close to and away from each other.

Effects of the Embodiment

If the guide rail 56 supporting the carriage 40 deforms, the top surface 51 of the guide rail 56 may become nonparallel to portions of the carriage 40 that contact the top surface 51 within the first region 74. Consequently, the carriage 40 sliding over the guide rail 56 may wear down portions of the guide rail 56 that contact the carriage 40. As a result, the gap between the recording head 38 and the sheet of recording paper 12 may vary, degrading the quality of images recording. Therefore, the embodiment configures the first region 74 to overlap the second region 75 with respect to the conveying direction 15. Accordingly, if the guide rail 56 deforms due to a reaction force applied to the guide rail 56 in response to the urging force of the coil springs 73 urging the pinch rollers 61 toward the conveying roller 60, the top surface 51 of the guide rail 56 can be maintained parallel to the portions of the carriage 40 that contact the top surface 51 in the region that the first region 74 and second region 75 overlap, thereby reducing wear from sliding of the carriage 40.

Further, by providing the roller holders 85 on the guide rail 56 in the embodiment, the roller holders 85 move in their entirety in response to deformation in the overall guide rail 56. Accordingly, the amount of pressure that the coil springs 73 apply to the guide rail 56 and pinch rollers 61 is unlikely to change.

Further, the roller holders 85 of the embodiment are engaged with the guide rail 56 at a different position from the first region 74 with respect to the conveying direction 15. Therefore, the first region 74 is affected little by deformation in the guide rail 56 that is caused by the engagement between the roller holders 85 and guide rail 56. This configuration reduces the adverse effects of such deformation on parallelism between the top surface 51 and portions of the carriage 40 that contact the top surface 51 within the first region 74 while allowing the roller holders 85 to be attached to the guide rail 56.

In the embodiment, the carriage 40 contacts the guide rail 56 near a bent part. Since the guide rail 56 has greater rigidity near its bent parts, the carriage 40 in the embodiment contacts the guide rail 56 at a position in which the guide rail 56 has greater rigidity and is less likely to deform. Thus, the embodiment can reduce the effects of deformation in the guide rail 56 on the carriage 40.

In the embodiment, a sheet of recording paper 12 conveyed along the conveying path 65 presses against the contact members 41 so that the contact members 41 are displaced a distance equivalent to the thickness of the sheet. When the contact members 41 are displaced by pressure from the sheet, the protruding parts 79 of the contact members 41 press against the support part 67 of the guide rail 56, causing the support part 67 to deform in the direction toward the top surface 51 side, i.e., in the direction to press against the carriage 40. However, since the first region 74 and third region 80 overlap with respect to the conveying direction 15 in the structure of the embodiment, displacement in the contact members 41 that has occurred after the protruding parts 79 of the contact members 41 contacted the bottom surface 50 of the support part 67 is maintained equal to displacement in the carriage 40 that has caused by pressure from the support part 67. Accordingly, the structure of the embodiment can maintain a constant gap between the distal ends 78 of the contact members 41 and the recording head 38 mounted in the carriage 40, even when movement of the contact members 41 corresponding to the thickness of the recording paper 12 produces deformation in the support part 67. Thus, this configuration can reduce the effects that deformation in the support part 67 of the guide rail 56 supporting the carriage 40 has on the quality of image recording on the recording paper 12.

Further, the contact members 41 are disposed at the guide rail 56 in the embodiment. With this construction, the contact members 41 as a whole move in response to the overall deformation in the guide rail 56 so that the positional relationship between the distal ends 78 and the recording head 38 is unlikely to fluctuate.

In the embodiment, the contact members 41 are engaged with the guide rail 56 at a position outside the first region 74 with respect to the conveying direction 15. Accordingly, the first region 74 is affected little by deformation in the guide rail 56 caused by this engagement. In this way, the contact members 41 can be disposed on the guide rail 56 while minimizing the effects on parallelism between the top surface 51 and the portions of the carriage 40 that contact the top surface 51 within the first region 74.

In the embodiment, moving the movable members 90 also moves the shaft 87 so that the distance between the shaft 87 and the rotational center of the conveying roller 60 can be changed. That is, moving the shaft 87 moves the axes of the pinch rollers 61 supported in the roller holders 85 through which the shaft 87 is inserted, allowing the distance between the axes of the pinch rollers 61 and the rotational center of the conveying roller 60 to be changed. In the embodiment, the shaft 87 that is moved by the movable members 90 in order to move the axes of the pinch rollers 61 is aligned in the left-right direction 9. When moving the axis of the shaft 87 and, hence, the axes of the pinch rollers 61, the reaction force to the urging force of the coil springs 73 for urging the pinch rollers 61 against the conveying roller 60 can be applied to the guide rail 56 nearly uniformly along the left-right direction 9. In this way, the axes of the pinch rollers 61 can be moved with minimal adverse effects on parallelism between the top surface 51 and the portions of the carriage 40 that contact the top surface 51 within the first region 74.

While the invention has been described in detail with reference to the embodiments thereof, it would be apparent to those skilled in the art that various changes and modifications may be made therein without departing from the spirit of the invention.

What is claimed is:

1. An inkjet recording apparatus comprising:

a carriage configured to move in a width direction orthogonal to a conveying direction in which a sheet is conveyed, the carriage supporting a recording head configured to eject ink droplets from nozzles onto the sheet conveyed, thereby recording an image on the sheet;

a support frame having a support part of a flat plate shape extending in both the conveying direction and the width direction, the support frame supporting the carriage on a first flat surface of the support part such that the carriage is movable in the width direction;

a pinch roller disposed on a second flat surface side of the support part, the second flat surface being opposite from the first flat surface with respect to an orthogonal direction, the orthogonal direction being orthogonal to both the conveying direction and the width direction;

a conveying roller disposed opposite to the support frame relative to the pinch roller and in confrontation with the pinch roller, the conveying roller being configured to convey the sheet that is interposed between the conveying roller and the pinch roller;

a roller holder disposed on the second flat surface side of the support part with respect to the orthogonal direction and supporting the pinch roller; and an urging member interposed between the roller holder and the support part, the urging member being configured to urge the roller holder so as to press the pinch roller against the conveying roller, wherein the carriage is in contact with the first flat surface of the support part while the urging member is in contact with the second flat surface of the support part, and wherein a first region in which the carriage contacts the first flat surface of the support part and a second region in which the urging member contacts the second flat surface of the support part overlap with respect to the conveying direction.

2. The inkjet recording apparatus according to claim 1, wherein the roller holder is attached to the support frame.

3. The inkjet recording apparatus according to claim 1, wherein the support part of the support frame has a first opening, wherein the roller holder includes:

a first protruding part inserted through the first opening; and a first engaging part formed on the first protruding part and engaged with the first flat surface of the support part, and wherein the first region and an engagement region in which the first engaging part is engaged with the first flat surface of the support part are at different positions with respect to the conveying direction.

4. The inkjet recording apparatus according to claim 1, wherein at least one of an upstream edge and a downstream edge of the support frame in the conveying direction includes a bent part, and wherein a region of the support part in which the first region and the second region overlap each other with respect to the conveying direction is offset from a center region of the support part with respect to the conveying direction toward the bent part.

5. The inkjet recording apparatus according to claim 1, further comprising a contact member disposed upstream of the nozzles with respect to the conveying direction, the contact member including a first contact part configured to contact the sheet, and a second contact part configured to contact the second flat surface of the support part and to restrict movement of the first contact part toward the support frame, and wherein the first region in which the carriage contacts the first flat surface and a third region in which the second contact part contacts the second flat surface of the support part overlap with respect to the conveying direction.

6. The inkjet recording apparatus according to claim 5, wherein the contact member is attached to the support frame.

7. The inkjet recording apparatus according to claim 5, wherein the support part of the support frame has a second opening, wherein the contact member includes:

a second protruding part inserted through the second opening; and a second engaging part formed on the second protruding part and engaged with the first flat surface of the support part, and wherein the first region and an engagement region in which the second engaging part is engaged with the first flat surface of the support part are at different positions with respect to the conveying direction.

8. The inkjet recording apparatus according to claim 1, wherein a plurality of the pinch rollers are arranged in the width direction, a plurality of the roller holders are arranged in the width direction such that each roller holder supports corresponding at least one of the pinch rollers, and a plurality of the urging members are arranged in the width direction such that each urging member is disposed in contact with the second flat surface of the support part and a corresponding one of the roller holders.

9. The inkjet recording apparatus according to claim 8, further comprising:

an elongated member elongated in the width direction and penetrating the roller holders; and a movable member configured to move between a first position and a second position, wherein a distance is defined between the elongated member and an axis of the conveying roller in a movement direction that intersects both of the conveying direction and the width direction, wherein the movable member is configured to set the distance to a first distance when the movable member is at the first position, and set the distance to a second distance when the movable member is at the second position, the second distance being greater than the first distance, and wherein the movable member includes a guide part configured to guide the elongated member in the movement direction by contacting the elongated member, thereby causing the roller holders to move in the movement direction.

* * * * *